US009999918B2

(12) United States Patent
Killmore et al.

(10) Patent No.: US 9,999,918 B2
(45) **Date of Patent: *Jun. 19, 2018**

(54) THIN CAST STRIP PRODUCT WITH MICROALLOY ADDITIONS, AND METHOD FOR MAKING THE SAME

(75) Inventors: Christopher Ronald Killmore, Wollongong (AU); James Geoffrey Williams, Balgownie (AU)

(73) Assignee: Nucor Corporation, Charlotte, NC (US)

( * ) Notice: Subject to any disclaimer, the term of this patent is extended or adjusted under 35 U.S.C. 154(b) by 825 days.

This patent is subject to a terminal disclaimer.

(21) Appl. No.: 13/275,405

(22) Filed: Oct. 18, 2011

(65) Prior Publication Data

US 2012/0132323 A1 May 31, 2012

Related U.S. Application Data

(63) Continuation-in-part of application No. 11/744,881, filed on May 6, 2007, now abandoned, which is a (Continued)

(51) Int. Cl.
*B22D 11/00* (2006.01)
*B22D 11/06* (2006.01)

(Continued)

(52) U.S. Cl.
CPC ..... *B22D 11/001* (2013.01); *B22D 11/0622* (2013.01); *B22D 11/117* (2013.01); *C22C 38/02* (2013.01); *C22C 38/04* (2013.01)

(58) Field of Classification Search
CPC ..... C22C 38/04; C22C 38/02; C22C 38/14; C21D 9/46; B22D 11/001

(Continued)

(56) References Cited

U.S. PATENT DOCUMENTS 4,067,754 A 1/1978 Elias et al.
4,073,643 A 2/1978 Kumai et al.

(Continued)

FOREIGN PATENT DOCUMENTS

AT 313402 E 1/2006
AU 744196 B2 2/2002

(Continued)

OTHER PUBLICATIONS

Recent Development in Project M the Joint Development of Low Carbon Steel Strip Casting by BHP and IHI, presented at the METEC Congress 99, Dusseldorf Germany (Jun. 13-15, 1999), p. 176-181.

(Continued)

*Primary Examiner* — Weiping Zhu
(74) *Attorney, Agent, or Firm* — Hahn Loeser & Parks, LLP

(57) ABSTRACT

A steel product having, by weight, less than 0.25% carbon, between 0.20 and 2.0% manganese, between 0.05 and 0.50% silicon, aluminum 0.008% or less by weight, and at least one element selected from the group consisting of titanium between about 0.01% and about 0.20%, niobium between about 0.01% and about 0.20%, molybdenum between about 0.05% and about 0.50%, and vanadium between about 0.01% and about 0.20%, and having a microstructure comprised of a majority bainite, and fine oxide particles of silicon and iron distributed through the steel microstructure of average precipitate size less than 50 nanometers. The yield strength of the steel product may be at least 55 ksi (380 MPa) or the tensile strength of at least 500 MPa, or both. The steel product may have total elongation of at least 6% or 10%, and thickness less than 3.0 mm.

11 Claims, 4 Drawing Sheets

Related U.S. Application Data continuation-in-part of application No. 11/255,604, filed on Oct. 20, 2005, now Pat. No. 7,485,196.

(51) Int. Cl.
*B22D 11/117* (2006.01)
*C22C 38/02* (2006.01)
*C22C 38/04* (2006.01)

(58) Field of Classification Search
USPC ..... 148/541
See application file for complete search history.

(56) References Cited

U.S. PATENT DOCUMENTS

| | | | | |
|---|---|---|---|---|
| 4,082,576 | A | 4/1978 | Lake et al. | |
| 4,152,140 | A | 5/1979 | Hori et al. | |
| 4,468,249 | A | 8/1984 | Lehman | |
| 4,745,786 | A | 5/1988 | Wakako et al. | |
| 4,746,361 | A | 5/1988 | Pielet et al. | |
| 4,851,052 | A | 7/1989 | Nishioka et al. | |
| 5,336,339 | A * | 8/1994 | Yamamoto | C22C 38/14 148/320 |
| 5,720,336 | A | 2/1998 | Strezov | |
| 5,934,359 | A | 8/1999 | Strezov | |
| 6,059,014 | A | 5/2000 | Strezov | |
| 6,073,679 | A | 6/2000 | Strezov | |
| 6,129,791 | A | 10/2000 | Nakajima et al. | |
| 6,358,338 | B1 | 3/2002 | Guelton et al. | |
| 6,491,089 | B1 | 12/2002 | Poirier et al. | |
| 6,502,626 | B1 * | 1/2003 | Mascanzoni et al. | 164/476 |
| 6,547,849 | B2 | 4/2003 | Gross et al. | |
| 6,558,486 | B1 | 5/2003 | Strezov et al. | |
| 6,588,494 | B1 | 7/2003 | Mazurier et al. | |
| 6,663,725 | B2 | 12/2003 | Inoue et al. | |
| 6,818,073 | B2 | 11/2004 | Strezov | |
| 6,855,218 | B1 | 2/2005 | Kawalla et al. | |
| 6,942,013 | B2 | 9/2005 | Strezov et al. | |
| 7,048,033 | B2 | 5/2006 | Blejde et al. | |
| 7,252,722 | B2 | 8/2007 | Nakajima et al. | |
| 7,281,569 | B2 | 10/2007 | Blejde et al. | |
| 7,485,196 | B2 | 2/2009 | Blejde et al. | |
| 7,588,649 | B2 | 9/2009 | Blejde et al. | |
| 8,002,908 | B2 | 8/2011 | Blejde et al. | |
| 2003/0111206 | A1 | 6/2003 | Blejde et al. | |
| 2007/0212249 | A1 | 9/2007 | Killmore et al. | |
| 2008/0219879 | A1 | 9/2008 | Williams | |

FOREIGN PATENT DOCUMENTS

| | | | |
|---|---|---|---|
| AU | 2001291499 | B2 | 4/2002 |
| AU | 2005200300 | | 8/2005 |
| BR | 9810193 | A | 8/2000 |
| BR | 200114338 | A | 12/2003 |
| CA | 2294333 | A1 | 12/1998 |
| CA | 2284124 | | 9/1999 |
| CA | 2420492 | A1 | 4/2002 |
| CN | 1260740 | A | 7/2000 |
| CN | 1458870 | | 11/2003 |
| CZ | 293823 | B6 | 8/2004 |
| DE | 265641 | | 3/1989 |
| DE | 69832886 | | 1/2006 |
| EP | 0732163 | | 9/1996 |
| EP | 0800881 | A2 | 10/1997 |
| EP | 1007248 | A1 | 6/2000 |
| EP | 1143022 | A1 | 10/2001 |
| EP | 1399598 | | 6/2002 |
| JP | 57-130750 | A2 | 8/1982 |
| JP | 57-134249 | | 8/1982 |
| JP | 58-031026 | | 2/1983 |
| JP | 58-113318 | | 7/1983 |
| JP | 58-193319 | | 11/1983 |
| JP | 62-050054 | | 3/1987 |
| JP | 64-17824 | A | 1/1989 |
| JP | 02-160145 | A2 | 6/1990 |
| JP | 02-179343 | | 7/1990 |
| JP | 02-179843 | | 7/1990 |
| JP | 02-205618 | | 8/1990 |
| JP | 03-249126 | | 7/1991 |
| JP | 03-249128 | | 7/1991 |
| JP | 03-291139 | | 12/1991 |
| JP | 04-325657 | | 11/1992 |
| JP | 05-017821 | A | 1/1993 |
| JP | 05-171293 | | 7/1993 |
| JP | 05-289549 | | 10/1995 |
| JP | 08-053714 | A | 2/1996 |
| JP | 08-188847 | A | 7/1996 |
| JP | 08-281382 | A2 | 10/1996 |
| JP | 08-294751 | A2 | 11/1996 |
| JP | 10-219392 | A | 8/1998 |
| JP | 11-158538 | A | 6/1999 |
| JP | 2000-178634 | | 6/2000 |
| JP | 2001-502974 | | 3/2001 |
| JP | 2001-123245 | | 5/2001 |
| JP | 2001-152255 | | 5/2001 |
| JP | 13-152255 | | 6/2001 |
| JP | 2001-342543 | | 12/2001 |
| JP | 2001-355039 | | 12/2001 |
| JP | 2003-138340 | | 5/2003 |
| JP | 2004-018971 | | 1/2004 |
| JP | 2004-508942 | | 3/2004 |
| JP | 2004-211157 | | 7/2004 |
| KR | 1020010013946 | | 2/2001 |
| KR | 1020010075195 | | 8/2001 |
| KR | 2002-0040210 | | 6/2002 |
| KR | 2002-0048034 | | 6/2002 |
| KR | 2002-0048199 | | 6/2002 |
| KR | 1020030064760 | | 8/2003 |
| MX | PA03001971 | A | 8/2003 |
| PL | 186657 | B1 | 9/2004 |
| RU | 2212976 | C2 | 9/2003 |
| SK | 181499 | A3 | 3/2001 |
| TR | 9903146 | T2 | 7/2000 |
| UA | 61113 | C2 | 8/2000 |
| WO | 94/12300 | A1 | 6/1994 |
| WO | 95/13889 | A1 | 5/1995 |
| WO | 9513155 | | 5/1995 |
| WO | 98/57767 | A1 | 12/1998 |
| WO | 9855251 | A | 12/1998 |
| WO | 0007753 | | 2/2000 |
| WO | 01/20051 | A1 | 3/2001 |
| WO | 0226422 | A1 | 4/2002 |
| WO | 03/002772 | A1 | 1/2003 |
| WO | 03024644 | | 3/2003 |
| WO | 2005031021 | | 4/2005 |

OTHER PUBLICATIONS

PCT/AU2007/903665 International Search Report.

Constitution and Properties of Steels, Materials Science and Technology, 1992, pp. 49, 272, 273, 337, 350, 351, vol. 7, VCH Verlagsgesellschaft mbH, Federal Republic of Germany.

E. J. Schneider and B. Pollard, Titanium-Bearing High Strength Cold Rolled Steels, Proceedings of the 22nd Mechanical Working & Steel Processing Conference XVIII, Oct. 29-30, 1980, pp. 398-429, Toronto, Ontario.

P. B. Lake and J. J. Grenwal T, Partially Annealed High Strength Cold Rolled Steels, Bibliotheek T.U.E. ADM., Nov. 7, 2015, pp. 1-12, Society of Automotive Engineers, Inc.

J. Penning, J. Dilewijns, Y. Houbaert, U. Meers, N. Prom, R. Bul The, The development of recovery annealed steels, International Journal of Materials and Product Technology, 1995, vol. 10, Nr. 3-6, pp. 325-337, Inderscience Engerprises Ltd.

PCT International Search Report, Application No. PCT/US2008/062776 , dated Oct. 15, 2008.

PCT International Search Report, Application No. PCT/US2008/062781 , dated Oct. 15, 2008.

PCT International Search Report, Application No. PCT/US2008/062783, dated Oct. 15, 2008.

P. Maugis, S. Lanteri, D. Ravaine, P. Barges, M. Goune, Y. Bi, M. Lamberigts, T. Siwecki, European Commission, Technical Steel

(56) References Cited

OTHER PUBLICATIONS

Research, Physical metallurgy of rolling and finishing, Development of methods for the characterisation and modelling of precipitation in steels, Jul. 1, 1999 to Jun. 30, 2002, Contract No. 721 0-PRI160, Final Report,pp. 20,21,23,35,42,45,46,48,51,84, 139, 140,187,188,190,191,205,206,209,212, European Communities, 2004, Luxembourg.

V. Ludlow, D. Senk, G. Alvarez De Toledo, S. Zajac, KT Muller, European Commission, Technical Steel Research, Casting, reheating and direct rolling, Precipitation of nitrides and carbides during solidification and cooling, Copntract No. 7210-PRI213, Jul. 1, 2000 to Jun. 30, 2004, Final Report, pp. 43,135-137,140,141,144,145,147-149, 152, 154, 155, 197,245,247,277,289, European Communities 2006, Luxembourg.

Klaus Hulka, Niobium Products Company GmbH, DUsseldorf, Germany, The Role of Niobium in Low Carbon . Bianitic HSLA Steel.

V. Schwinn, P. Fluess, D. Ormston, Low carbon bainitic TMCP plate for structural and linepipe applications.

P.J.P. Bordignon, K. Hulka, B.L. Jones, High Strength Low-Alloy Steels for Automotive Applications, Niobium Technical Report, NbTR-06/84, Dec. 19841SSN-0101-5963.

PCT International Search Report, Application No. PCT/AU 94100678; completed Jan. 24, 1995 and dated Feb. 7, 1995.

PCT International Search Report, Application No. PCTO/AU98/ 00412.

PCT International Search Report, Application No. PCT/AU99/ 00641.

PCT International Search Report, Application No. PCT/AU02/ 01257.

PCT International Search Report, Application No. PCT/ J20041010571.

Patent Abstracts of Japan, English Translation JP-04-325657.

Patent Abstracts of Japan, English Translation JP-05-171293.

* cited by examiner

THIN CAST STRIP PRODUCT WITH MICROALLOY ADDITIONS, AND METHOD FOR MAKING THE SAME

CROSS-REFERENCE TO RELATED APPLICATIONS

This application claims priority to U.S. patent application Ser. No. 11/744,881 filed May 6, 2007, which claims priority to U.S. patent application Ser. No. 11/255,604, filed Oct. 20, 2005, now U.S. Pat. No. 7,485,196, the disclosures of which are incorporated herein by reference.

BACKGROUND AND SUMMARY

This invention relates to making of high strength thin cast strip, and the method for making such cast strip by a twin roll caster.

In a twin roll caster, molten metal is introduced between a pair of counter-rotated, internally cooled casting rolls so that metal shells solidify on the moving roll surfaces, and are brought together at the nip between them to produce a solidified strip product, delivered downwardly from the nip between the casting rolls. The term "nip" is used herein to refer to the general region at which the casting rolls are closest together. The molten metal is poured from a ladle through a metal delivery system comprised of a tundish and a core nozzle located above the nip to form a casting pool of molten metal, supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

In the past, high-strength low-carbon thin strip with yield strengths of 60 ksi (413 MPa) and higher, in strip thicknesses less than 3.0 mm, have been made by recovery annealing of cold rolled strip. Cold rolling was required to produce the desired thickness. The cold roll strip was then recovery annealed to improve the ductility without significantly reducing the strength. However, the final ductility of the resulting strip still was relatively low and the strip would not achieve total elongation levels over 6%, which is required for structural steels by building codes for structural components. Such recovery annealed cold rolled, low-carbon steel was generally suitable only for simple forming operations, e.g., roll forming and bending. To produce this steel strip with higher ductility was not technically feasible in these final strip thicknesses using the cold rolled and recovery annealed manufacturing route.

In the past, high strength, low carbon steel strip have also been made by microalloying with elements such as niobium, vanadium, titanium or molybdenum, and hot rolling to achieve the desired thickness and strength level. Such microalloying required expensive and high levels of niobium, vanadium, titanium or molybdenum and resulted in formation of a bainite-ferrite microstructure typically with 10 to 20% bainite. See U.S. Pat. No. 6,488,790. Alternately, the microstructure could be ferrite with 10-20% pearlite. Hot rolling the strip resulted in the partial precipitation of these alloying elements. As a result, relatively high alloying levels of the Nb, V, Ti or Mo elements were required to provide enough precipitation hardening of the predominately ferritic transformed microstructure to achieve the required strength levels. These high microalloying levels significantly raised the hot rolling loads needed and restricted the thickness range of the hot rolled strip that could be economically and practically produced. Such alloyed high strength strip could be directly used for galvanizing after pickling for the thicker end of the product range greater than 3 mm in thickness.

However, making of high strength, low carbon steel strip less than 3 mm in thickness with microalloying additions of Nb, V, Ti or Mo to the base steel chemistry was very difficult, particularly for wide strip due to the high rolling loads, and not always commercially feasible. For lower thicknesses of strip, cold rolling was required; however, the high strength of the hot rolled strip made such cold rolling difficult because of the high cold roll loadings required to reduce the thickness of the strip. These high alloying levels also considerably raised the recrystallization annealing temperature needed, requiring expensive to build and operate annealing lines capable of achieving the high annealing temperature needed for full recrystallization annealing of the cold rolled strip.

In short, the application of previously known microalloying practices with Ni, V, Ti or Mo elements to produce high strength thin strip could not be commercially produced economically because of the high alloying costs, difficulties with high rolling loads in hot rolling and cold rolling, and the high recrystallization annealing temperatures required.

The invention presently disclosed is a steel product comprised, by weight, of less than 0.25% carbon, between 0.2 and 2.0% manganese, between 0.05 and 0.5% silicon, less than 0.06% aluminum, and at least one element selected from the group consisting of titanium between about 0.01% and about 0.20%, niobium between about 0.01% and about 0.20%, molybdenum between about 0.05% and about 0.50%, and vanadium between about 0.01% and about 0.20%, and having a majority of the microstructure comprised of bainite and fine oxide particles containing silicon and iron distributed through the steel microstructure having an average precipitate size less than 50 nanometers. The steel product may be further comprised of a more uniform distribution of microalloys through the microstructure than previously produced with conventional slab cast product. Alternatively, aluminum may be 0.008% or less by weight.

Alternatively or in addition, the low carbon steel product may have a total elongation greater than 6% or greater than 10%. The steel product may have yield strength of at least 55 ksi (380 MPa) or a tensile strength of at least 500 MPa, or both.

In addition, a thin cast strip is disclosed comprising, by weight, less than 0.25% carbon, between 0.20 and 2.0% manganese, between 0.05 and 0.50% silicon, less than 0.06% aluminum, and between about 0.01% and about 0.20% niobium, and having a microstructure comprised of a majority of bainite. The thin cast strip may have fine oxide particles of silicon and iron distributed through the steel microstructure having an average precipitate size less than 50 nanometers. The steel product may be further comprised of a more uniform distribution of microalloys through the microstructure than previously produced with conventional slab cast product. Alternatively, aluminum may be 0.008% or less by weight.

The thin cast strip may a thickness less than 3 mm, or less than 2.5 mm, or less than 2 mm down to as thin as commercially feasible. The thin cast strip may have a thickness in the range from about 0.5 mm to about 2 mm. The thin cast strip may have a total elongation greater than 6% or greater than 10%. The steel product may have yield strength of at least 55 ksi (380 MPa) or a tensile strength of at least 500 MPa, or both.

In addition, a method is disclosed of preparing a thin cast steel strip comprising the steps of:

assembling a roll caster having laterally positioned casting rolls forming a nip between them, and forming a casting pool of molten low carbon steel supported on the casting rolls above the nip and confined adjacent the ends of the casting rolls by side dams, counter rotating the casting rolls to solidify metal shells on the casting rolls as the rolls move through the casting pool;

forming from the metal shells downwardly through the nip between the casting rolls a steel strip; and cooling the steel strip at a rate above 10° C. per second to produce a steel strip having a composition comprising by weight, less than 0.25% carbon, between 0.50 and 2.0% manganese, between 0.05 and 0.50% silicon, less than 0.06% aluminum, and between about 0.01% and about 0.20% niobium, and having a microstructure with a majority comprised of bainite. Alternatively, aluminum may be 0.008% or less by weight.

The steel strip as coiled may have fine oxide particles of silicon and iron distributed through the steel microstructure having an average precipitate size less than 50 nanometers.

The method of preparing a thin cast steel strip may further comprise the steps of: hot rolling the low carbon steel strip; and coiling the hot rolled low carbon steel strip at a temperature in the range from about 500-700° C.

The method of preparing a thin cast steel strip may also comprise the step of precipitation hardening the low carbon steel strip to increase the tensile strength at a temperature of at least 550° C.

The precipitation hardening may occur at a temperature between 650° C. and 800° C. or between 675° C. and 750° C.

The precipitation hardening may occur during the processing of the strip through a galvanizing line or continuous annealing line, or other heat treating process.

BRIEF DESCRIPTION OF THE DRAWINGS

In order that the invention may be described in more detail, some illustrative examples will be given with reference to the accompanying drawings in which.

DETAILED DESCRIPTION OF THE DRAWINGS

The following description of the embodiments is in the context of high strength thin cast strip with microalloy additions made by continuous casting steel strip using a twin roll caster. The embodiments described herein are not limited to the use of twin roll casters and extends to other types of continuous strip casters.

Figure 1:
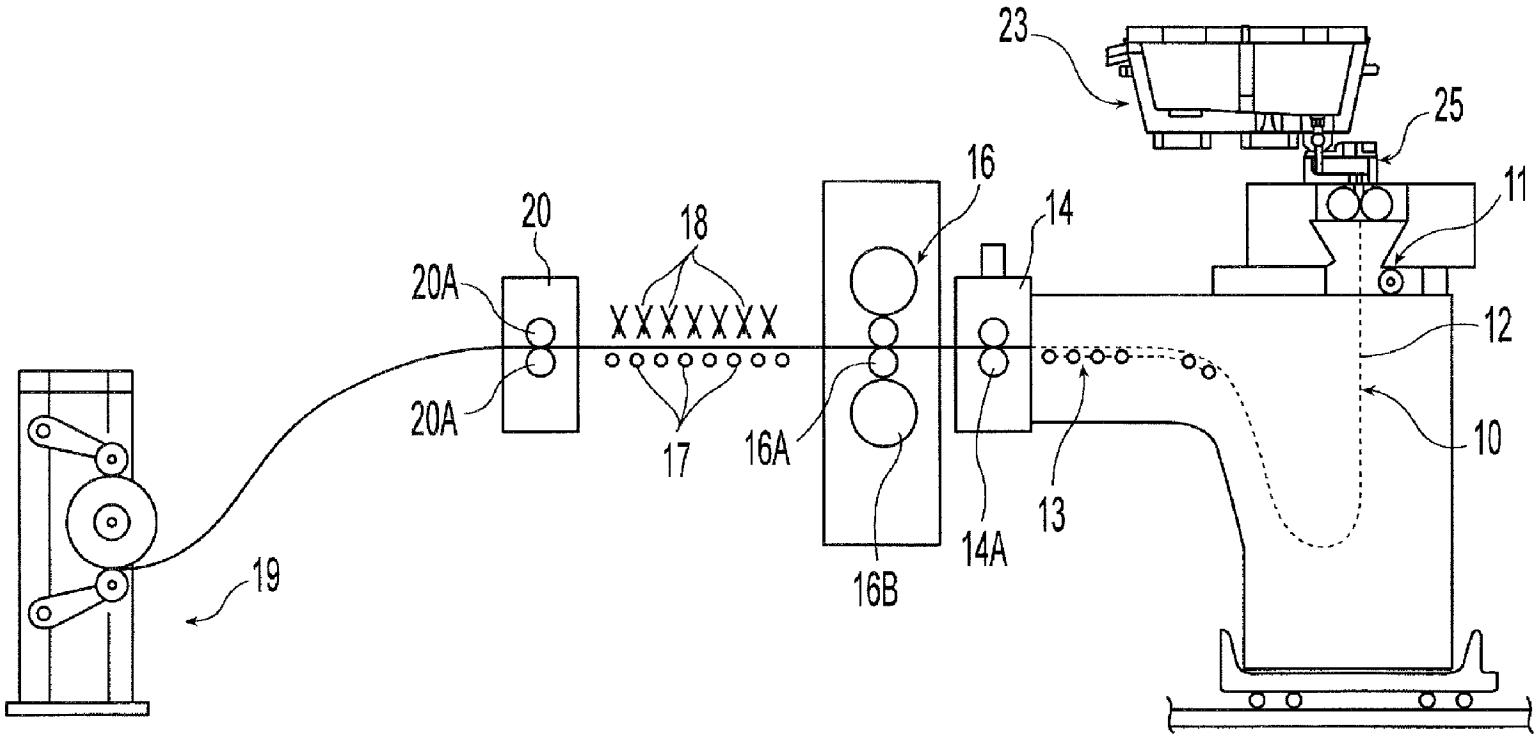
FIG. 1 illustrates a strip casting installation incorporating an in-line hot rolling mill and coiler.
Figure 2:
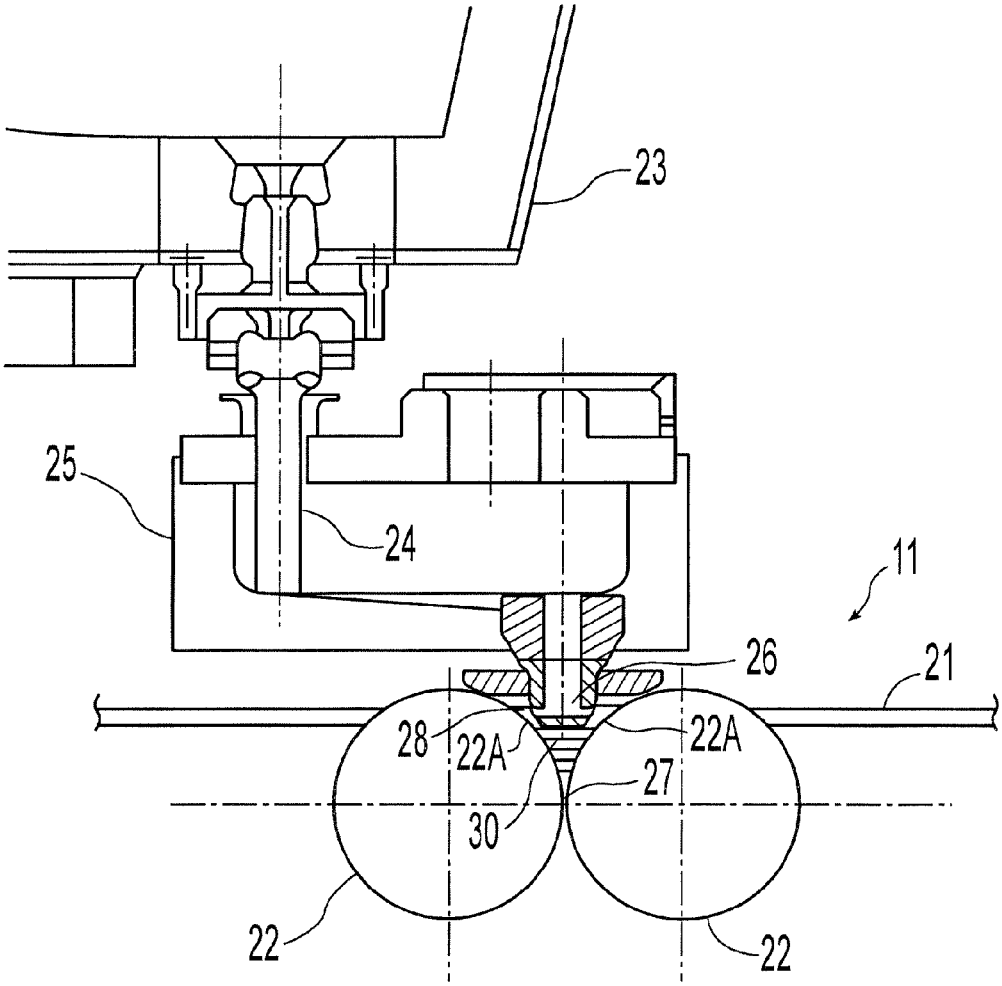
FIG. 2 illustrates details of the twin roll strip caster.

FIG. 1 illustrates successive parts of strip caster for continuously casting steel strip. FIGS. 1 and 2 illustrate a twin roll caster 11 that continuously produces a cast steel strip 12, which passes in a transit path 10 across a guide table 13 to a pinch roll stand 14 having pinch rolls 14A. Immediately after exiting the pinch roll stand 14, the strip passes into a hot rolling mill 16 having a pair of reduction rolls 16A and backing rolls 16B where the cast strip is hot rolled to reduce a desired thickness. The hot rolled strip passes onto a run-out table 17 where the strip may be cooled by convection and contact with water supplied via water jets 18 (or other suitable means) and by radiation. The rolled and cooled strip is then passes through a pinch roll stand 20 comprising a pair of pinch rolls 20A and then to a coiler 19. Final cooling of the cast strip takes place after coiling.

As shown in FIG. 2, twin roll caster 11 comprises a main machine frame 21 which supports a pair of laterally positioned casting rolls 22 having casting surfaces 22A. Molten metal is supplied during a casting operation from a ladle (not shown) to a tundish 23, through a refractory shroud 24 to a distributor or moveable tundish 25, and then from the tundish 25 through a metal delivery nozzle 26 between the casting rolls 22 above the nip 27. The molten metal delivered between the casting rolls 22 forms a casting pool 30 above the nip. The casting pool 30 is restrained at the ends of the casting rolls by a pair of side closure dams or plates 28, which are pushed against the ends of the casting rolls by a pair of thrusters (not shown) including hydraulic cylinder units (not shown) connected to the side plate holders. The upper surface of casting pool 30 (generally referred to as the "meniscus" level) usually rises above the lower end of the delivery nozzle so that the lower end of the delivery nozzle is immersed within the casting pool 30. Casting rolls 22 are internally water cooled so that shells solidify on the moving roller surfaces as they pass through the casting pool, and are brought together at the nip 27 between them to produce the cast strip 12, which is delivered downwardly from the nip between the casting rolls.

The twin roll caster may be of the kind which is illustrated and described in some detail in U.S. Pat. Nos. 5,184,668 and 5,277,243 or U.S. Pat. No. 5,488,988. Reference may be made to those patents for appropriate construction details of a twin roll caster appropriate for use in an embodiment of the present invention.

A high strength thin cast strip product can be produced using the twin roll caster that overcomes the shortcomings of conventional light gauge steel products and produces a high strength, light gauge, low carbon, steel strip product. Low carbon steel here refers to steels having a carbon level below 0.1% by weight. The invention utilizes the microalloying elements including niobium, vanadium, titanium or molybdenum or a combination thereof.

Microalloying elements in steel are commonly taken to refer to the elements titanium niobium, and vanadium. These microalloying elements were usually added in the past in levels below 0.1%, but in some cases levels as high as 0.2%. These microalloying elements are capable of exerting strong effects on the steel microstructure and properties via a combination of hardenability, grain refining and precipitation strengthening effects (in the past as carbonitride formers). Molybdenum has not normally regarded as a microalloying element since on its own it is a relatively weak carbonitride former, but in the present circumstances carbonitdride formation is inhibited in the hot rolled strip with these microalloys as explained below.

The high strength thin cast strip product combines several attributes to achieve a high strength light gauge cast strip product by microalloying with these elements. Strip thicknesses may be less than 3 mm, less than 2.5 mm, or less than 2.0 mm, and may be in a range of 0.5 mm to 2.0 mm. The cast strip is produced by hot rolling without the need for cold rolling to further reduce the strip to the desired thickness. Thus, the high strength thin cast strip product overlaps both the light gauge hot rolled thickness ranges and the cold rolled thickness ranges desired. The strip may be cooled at a rate of 10° C. per second and above, and still form a microstructure that is a majority and typically predominantly bainite.

The benefits achieved through the preparation of such a high strength thin cast strip product are in contrast to the production of previous conventionally produced microalloyed steels which results in relatively high alloy costs, difficulties in hot and cold rolling and difficulties in recrystallation annealing since conventional continuous galvanizing and annealing lines are not capable of providing the high annealing temperatures needed. Moreover, the relatively poor ductility exhibited with strip made the cold rolled and recovery annealed manufacturing route is overcome.

The high strength thin cast steel strip product was produced comprising, by weight, less than 0.25% carbon, between 0.20 and 2.00% manganese, between 0.05 and 0.50% silicon, less than 0.06% aluminum, and at least one element selected from the group consisting of titanium between about 0.01% and about 0.20%, niobium between about 0.01% and about 0.20%, molybdenum between about 0.05% and about 0.50%, and vanadium between about 0.01% and about 0.20%, and having a microstructure comprising a majority bainite. The steel product may further comprising fine oxide particles of silicon and iron distributed through the steel microstructure having an average precipitate size less than 50 nanometers. The steel product may be further comprised of a more uniform distribution of microalloys through the microstructure than previously produced with conventional slab cast product. In certain alternatives, aluminum may be 0.008% or less by weight.

Alternatively or in addition, the low carbon steel product may have a total elongation greater than 6% or greater than 10%. The steel product may have a yield strength of at least 55 ksi (380 MPa) or a tensile strength of at least 500 MPa, or both.

After hot rolling the hot rolled low carbon steel strip may be coiled at a temperature in the range from about 500-700° C. The thin cast steel strip may also be further processed by precipitation hardening the low carbon steel strip to increase the tensile strength at a temperature of at least 550° C. The precipitation hardening may occur at a temperature between 550° C. and 800° C. or between 675° C. and 750° C. Conventional furnaces of continuous galvanizing or annealing lines are thus capable of providing the precipitation hardening temperatures needed to harden the microalloyed cast strip product.

For example, a steel composition was prepared by making a steel composition of a 0.026% niobium, 0.04% by weight carbon, 0.85% by weight manganese, 0.25% by weight silicon that has been cast by a thin cast strip process. The strip was cast at 1.7 mm thick and inline hot rolled to a range of strip thickness from 1.5 mm to 1.1 mm using a twin roll caster as illustrated in FIGS. 1 and 2. The strip was coiled at coiling temperatures of 590-620° C. (1094-1148° F.).

Figure 3:
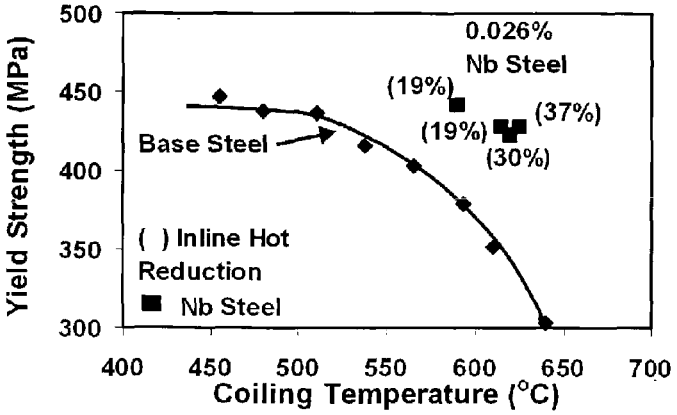
FIG. 3 illustrates the effect of coiling temperature on strip yield strength with and without microalloy additions.

As shown in FIG. 3, the yield and tensile strength levels achieved in the microalloyed cast strip are compared to the yield and tensile strength levels achievable in the base, non-microalloyed, cast strip steel composition over a range of coiling temperatures. It can be seen that the niobium microalloyed steel strip achieved yield strengths in the range of 420-440 MPa (~61-64 ksi) and tensile strengths of about 510 MPa (~74 ksi). The Nb cast strip product is compared to C—Mn—Si base steel compositions processed with the same coiling temperature as the niobium microalloyed steel, and the niobium microalloyed steel produced substantially higher strength levels. The compared steel strip had to be coiled at very low temperatures to approach comparable strength levels to the cast niobium microalloyed steel product. The cast niobium steel product did not need to be coiled at low coiling temperatures to achieve its strengthening potential with the hot rolling. Moreover, the yield and tensile strength levels for the cast niobium microalloyed steel was not significantly affected by the degree of inline hot rolling with a reduction of 19 to 37%.

The thin cast strip niobium steel product had consistent yield and tensile strength levels over the range of hot rolling applied during the trial (reduction 19 to 37%). The prior austenite grain size was determined for each strip thickness. The austenite grain size measurements indicated that only very limited recrystallization had occurred at high hot rolling reductions, whereas in the comparable base steel strip, the microstructure almost fully recrystallized at hot rolling reductions over about 25%. The addition of the microalloying element niobium to the cast steel strip suppressed the recrystallization of the coarse as-cast austenite grain size during the hot rolling process, and resulted in the hardenability of the steel being retained after hot rolling.

Figure 4A:
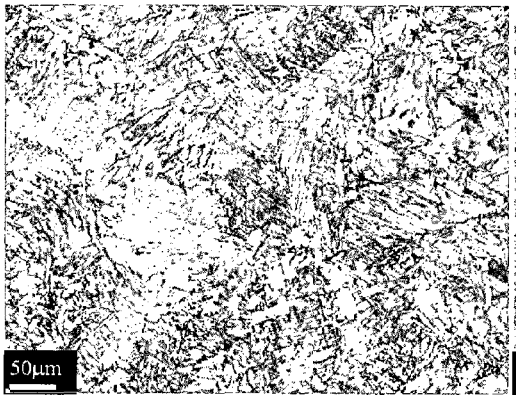
FIG. 4*a* is an optical micrograph of a microalloyed steel strip.
Figure 4B:
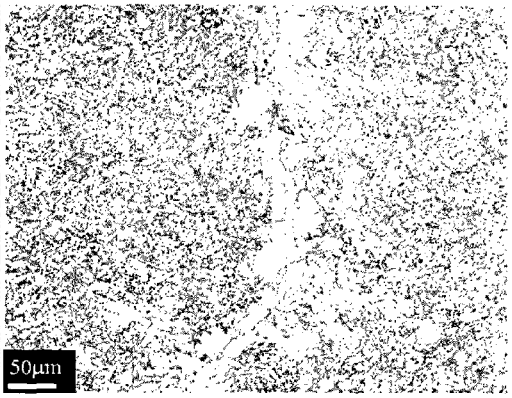
FIG. 4*b* is an optical micrograph of a standard UCS SS Grade 380 steel strip.

The higher strength of the niobium microalloyed steel strip after hot rolling was mostly due to the microstructure formed. As shown in FIG. 4*a*, the microstructure of the cast niobium steel was comprised of a majority if not mostly bainite for all strip thicknesses. In contrast, as shown in FIG. 4*b*, the comparable non-microalloyed steel achieved similar strength by coiling at a low coiling temperature and had a microstructure comprising mostly acicular ferrite with some grain boundary ferrite. The microalloy addition of niobium to the steel strip provided an increase in the hardenability of the steel and suppressed the formation of the grain boundary ferrite and promoted the bainitic microstructure, even at considerably higher coiling temperatures.

In addition, transmission electron microscopy (TEM) examination did not reveal any substantial niobium precipitation in the as hot rolled cast strip. This indicates that the niobium had been retained in solid solution and that the strengthening produced was mainly attributed to the enhanced hardenability effect of the niobium resulting in the formation of a majority and likely predominantly bainitic microstructure. The hardenability of the cast steel strip is also believed to be enhanced by the retention of coarse austenite grain produced during formation of the cast strip. The transformation to bainite, rather than ferrite, is believed to be a major factor in suppressing the precipitation of the microalloy addition of niobium in the thin cast strip during cooling of the coil from the coiling temperature.

An additional factor believed to account for the absence of niobium rich precipitates in the hot rolled cast strip relates to the nature of the dispersion of niobium with the rapid solidification of the strip during its formation by the method of continuously making cast strip described. In previously made microalloyed high strength strip, relatively long time intervals were involved in the solidification with slab cooling, slab reheating and thermo-mechanical processing that permitted opportunities for pre-clustering and/or solid state precipitation of microalloy carbonitride particles such as (Nb, V, Ti, Mo)(CN) that enabled the kinetics for subsequent precipitation in various stages of the manufacturing process. In the process described, where the cast strip is continuously formed from a casting pool between casting rolls, the extremely rapid initial solidification in forming the cast strip (in about 160 microseconds) is believed to inhibit pre-clustering and/or solid state precipitation of microalloy carbonitride particles, and in turn, slow and reduce the kinetics for precipitation of the microalloys in subsequent processing including rolling and coiling operations. This means that the microalloys of Nb, V, Ti, and Mo are relatively more uniformly distributed in the austenite and ferrite phases, than in thin steel strip previously made by conventional slab casting and processing.

Atom probe analysis of Nb microalloyed cast strip made by forming from a casting pool between casting rolls as above described has verified the more uniform distribution of microalloys (indicating reduced pre-clustering and/or solid state precipitation) in both the as cast and the hot rolled strip when coiled at about 600° C. or lower. This more uniform distribution of microalloys is believed to be inhibiting the precipitation of microalloy carbonitrides in the coiling operation under conditions where fine coherent precipitation are of such microalloys occurred in previous conventionally made and processed microalloyed slab cast steel. The reduction or absence of pre-clustering and/or solid state precipitation of carbonitrides in the Nb microalloyed cast strip made by forming from a casting pool between casting rolls also slows the kinetics of precipitation of microalloys during subsequent thermo-mechanical processing such as annealing. This then permits the opportunity for precipitation hardening at temperatures higher than those where the particles in previously conventionally processed strip lost their strengthening capacity through coarsening (Ostwald ripening) mechanisms.

Figure 5:
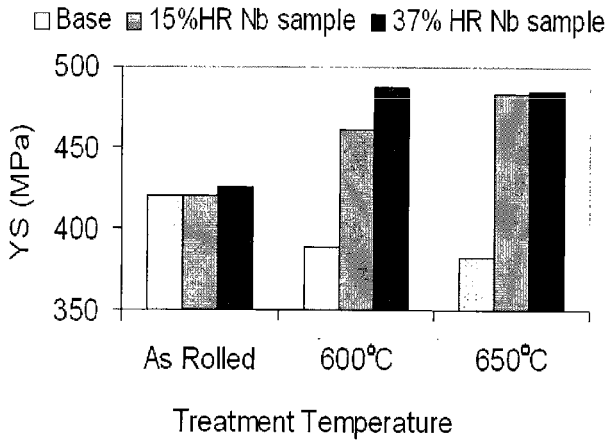
FIG. 5 is graph showing the effect of post coil heat treatment on yield strength of a microalloyed steel strip.

Laboratory ageing heat treatments were then conducted at various temperatures and times to induce precipitation of the niobium, that was believed retained in solid solution in the hot rolled strip. As shown in FIG. 5, ageing heat treatments produced a significant increase in strength, with yield strengths of about 480 MPa (~70 ksi). This confirmed that the niobium was retained in a solid solution and was available to provide precipitation hardening on subsequent ageing, for example, through the use of an annealing furnace on continuous galvanizing lines or by using a continuous annealing line. Accordingly, short time ageing heat treatments were carried out to simulate the ageing potential from processing the niobium microalloyed cast steel product through an annealing furnace attached to continuous galvanizing line or conventional continuous annealing line. In the latter case the precipitation hardened high strength strip product maybe subsequently galvanized, painted or utilized uncoated.

Figure 6:
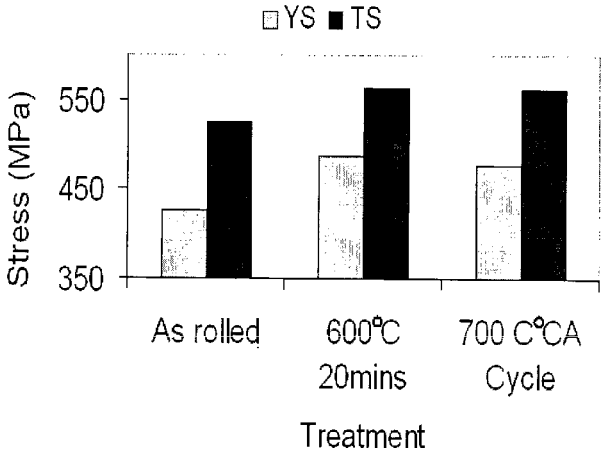
FIG. 6 is a graph showing the effect of post coiling simulated heat treatment cycle on yield and tensile strength of a microalloyed steel strip.

The results, as shown in FIG. 6, clearly show that for a peak processing temperature of 700° C. (1292° F.), significant precipitation strengthening was realized, with strength levels approaching that achieved for the longer times at lower temperatures. The tensile properties of the niobium microalloyed thin cast steel product after the short time ageing treatment using a peak temperature of 700° C. (1292° F.) are given in Table 1. Besides the high strength of the cast strip product, the ductility and formability is satisfactory for structural quality products. The cast strip product produced is a thin, high strength strip product for structural applications through the use of niobium microalloying. It is contemplated that higher microalloying levels would realize even higher yield strengths, potentially well in excess of 550 MPa (~80 ksi).

TABLE 1

| Strip Thickness, mm | Yield Strength, MPa | Tensile Strength, MPa | Total Elongation, % | YS/TS | 'n' Value | 'r' Value |
|---|---|---|---|---|---|---|
| 1.1 | 477 | 563 | 18 | 0.85 | 0.12 | 0.90 |

Thus, it has been shown that the microalloyed Nb cast strip results in light gauge, high strength, steel product. The Nb addition firstly is capable of suppressing the austenite recrystallization during hot rolling which enhances the hardenability of the steel by retaining the relatively coarse as cast austenite size. The Nb being retained in solid solution in austenite after hot rolling, then directly increases the steel's hardenability, which assists in transforming the austenite to a final microstructure comprised mostly of bainite, even at relatively high coiling temperatures. The formation of a bainitic microstructure promoted the retention of the Nb addition in solid solution in the hot rolled strip. Furthermore it was determined that the retention of the niobium in solid solution by the prior processing conditions, provided considerable precipitation hardening during a subsequent ageing heat treatment cycle. Such a heat treatment cycle can be produced using a suitable continuous galvanizing line or continuous annealing facility. Hence a microalloyed steel strip made using a thin strip casting process, combined with an ageing hardening heat treatment provided by a suitable galvanizing line or annealing line, is a unique manufacturing path providing a unique strengthening approach for this type of steel product.

With a precipitation hardening heat treatment, an even higher tensile strength was found to be achievable. For example, with a 0.026% niobium addition, an increase of at least a 5 ksi increase in yield strength from 60-65 ksi was observed. With a 0.05% niobium addition, it is contemplated that with a precipitation hardening heat treatment, an increase of at least 10 ksi is expected, and a with 0.1% niobium addition, it is contemplated that with a precipitation hardening heat treatment, an increase of at least 20 ksi is expected. An annealing furnace may be used to induce the precipitation hardening heat treatment, which is not a current strengthening approach for processing such products. The annealing condition may be a continuous annealing cycle with a peak temperature of at least 650° C. and less than 800° C. and better 675° C. to 750° C.

Similar results are contemplated with niobium between about 0.01% and about 0.20%, as well as with titanium between about 0.01% and about 0.20%, molybdenum between about 0.05% and about 0.50%, and vanadium between about 0.01% and about 0.20%.

This microalloyed thin cast strip enables production of new steel product types including:

1. A high strength, light gauge, galvanized strip by utilizing a microstructure that has bainite as the major constituent and age hardening during the galvanizing process. The annealing section of the galvanizing line can be used to induce precipitation hardening of the microalloying elements of the thin cast strip that has been hot rolled.

2. A high strength, light gauge, uncoated strip by utilizing a microstructure that is majority bainite and age hardened during processing on a continuous annealing line. The high temperature furnace of the conventional continuous annealing can be used to induce precipitation of the microalloying elements retained in solid solution by the bainite microstructure after hot rolling of the thin cast strip.

3. A high strength, light gauge, hot rolled cast strip product where the strength levels are insensitive to the degree of hot rolling reduction applied. The bainitic microstructure produces a relatively high strength product (YS≥380 MPa (~55 ksi)). The suppression of austenite recrystallization during or after hot rolling can provide final strength levels insensitive to the degree of hot rolling reduction. The final strength levels will be consistent across a range of thicknesses that can be produced by a thin cast strip process.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A coiled thin cast steel strip having a strip thickness of less than 3.0 mm, and a total strip elongation of at least 6% and comprising, by weight, less than 0.25% carbon, between 0.20 and 2.0% manganese, between 0.05 and 0.50% silicon, aluminum 0.008% or less, and niobium between about 0.01% and about 0.20% by weight, and having a majority of its microstructure comprised of bainite, with the niobium retained in solid solution during coiling, and comprising fine oxide particles of silicon and iron distributed through the steel microstructure having an average precipitate size less than 50 nanometers.

2. The coiled thin cast steel strip as claimed in claim 1 having a yield strength of at least 55 ksi (380 MPa).

3. The coiled thin cast steel strip as claimed in claim 1 having a tensile strength of at least 72 ksi (500 MPa).

4. The coiled thin cast steel strip as claimed in claim 1 having a thickness of less than 2.5 mm.

5. The coiled thin cast steel strip as claimed in claim 1 having a thickness of less than 2.0 mm.

6. The coiled thin cast steel strip as claimed in claim 1 having a thickness in the range from about 0.5 mm to about 2 mm.

7. The coiled thin cast steel strip as claimed in claim 1 having a total elongation of at least 10%.

8. The coiled thin cast steel strip as claimed in claim 1, further comprising at least one element selected from the group consisting of titanium between about 0.01% and about 0.20%, molybdenum between about 0.05% and about 0.50%, and vanadium between about 0.01% and about 0.20%.

9. The coiled thin cast steel strip as claimed in claim 1, wherein the niobium retained in solid solution is available to provide precipitation hardening on subsequent ageing.

10. The coiled thin cast strip as claimed in claim 1, wherein the strip is coiled at a temperature in the range of about 500°-700° C.

11. The coiled thin cast strip as claimed in claim 10, having a yield strength in the range of 61-64 ksi (420-440 MPa) and a tensile strength of about 74 ksi (510 MPa).

* * * * *